US005136338A

United States Patent [19]

Greenaway et al.

[11] Patent Number: 5,136,338

[45] Date of Patent: Aug. 4, 1992

[54] METHOD AND APPARATUS FOR SOLID RECOVERY OF WASTE TONER

[75] Inventors: Richard P. Greenaway; Thomas W. Bober; Kent A. Randall, all of Rochester, N.Y.

[73] Assignee: Eastman Kodak Company, Rochester, N.Y.

[21] Appl. No.: 802,180

[22] Filed: Dec. 4, 1991

[51] Int. Cl.[5] ..... G03G 21/00

[52] U.S. Cl. ..... 355/298; 118/652

[58] Field of Search ..... 355/296, 298, 215; 118/652

[56] References Cited

U.S. PATENT DOCUMENTS

| | | | |
|---|---|---|---|
| 3,924,566 | 12/1975 | Dennie | 118/652 X |
| 4,264,966 | 4/1981 | Terzian | 368/82 |
| 4,271,497 | 6/1981 | Terzian | 368/82 |
| 4,483,628 | 11/1984 | Terzian | 368/82 |
| 4,627,737 | 12/1986 | Nance et al. | 368/239 |
| 4,724,459 | 2/1988 | Ford | 355/245 X |
| 4,992,830 | 2/1991 | Kohyama | 355/215 |

FOREIGN PATENT DOCUMENTS

| | | | |
|---|---|---|---|
| 0176079 | 9/1985 | Japan . | |
| 0223771 | 10/1986 | Japan | 355/298 |
| 0025780 | 2/1987 | Japan . | |
| 0235975 | 9/1988 | Japan | 355/298 |

*Primary Examiner*—A. T. Grimley
*Assistant Examiner*—William J. Royer
*Attorney, Agent, or Firm*—Tallam I. Nguti

[57] ABSTRACT

Apparatus for recovering waste toner in a copier or printer includes a rotatable heating drum and a heat source for heating the drum so that its exterior surface reaches a temperature sufficient to melt toner particles. Waste toner particles that are removed by a cleaning apparatus are fed through a chute onto the surface of the heating drum for melting. A rotatable receiving roller forms a transfer nip with the heating drum for transfer receiving melted toner from the heating drum. Melted toner on the receiving roller is cooled off into a solid mass or plug of toner for clean, safe disposal.

20 Claims, 7 Drawing Sheets

METHOD AND APPARATUS FOR SOLID RECOVERY OF WASTE TONER

BACKGROUND OF THE INVENTION

Field of the Invention

This invention relates to electrostatographic reproduction machines, and more particularly to apparatus for recovering waste toner particles from such machines.

Electrostatographic machines such as copiers and printers are well known for repeatably producing or reproducing quality copies of original documents using developer material containing toner particles. Typically in such machines, a latent image of an original document is formed electrostatically on a clean image-bearing surface and then developed or made visible with developer material made available at a development station of such machine. The developed image is then transferred from the image-bearing surface onto a suitable receiver sheet where it is subsequently fused to form a permanent copy of the original document. In order to ensure the quality of subsequent copies, residual or waste toner particles left on the image-bearing surface following each image transfer, for example, are removed at a cleaning station by a cleaning apparatus.

Waste toner particles being removed, as such, are powdery, very fine, and dusty, and ordinarily have a distinctive visible color, for example black. Consequently, such particles can easily become airborne, and therefore are normally a source of contamination within the machine. More importantly, the recovery and handling of such particles can understandably be very messy.

Special apparatus for recovering and handling such waste toner particles are disclosed for example in U.S. Pat. No. 4,724,459, issued Feb. 9, 1988 to Ford, and in U.S. Pat. No. 3,924,566, issued Dec. 9, 1975 to Dennie. In both patents, the powdery waste toner particles are collected or recovered into a plastic bottle for subsequent disposal or handling. Because handling such particles even in a plastic bottle can still be messy, it is suggested in the '566 patent (to Dennie) to heat the plastic bottle in order to solidify the waste toner inside such plastic bottle. Unfortunately, however, plastic bottles that are filled with a plastic-base powder or solid in this manner are difficult to sort and recycle among other such chemical waste, and are therefore more likely to be classified as unsafe chemical waste. There is, therefore, still a need for more satisfactory methods and apparatus for cleanly and safely recovering and handling waste toner particles from electrostatographic machines.

SUMMARY OF THE INVENTION

It is, therefore, an object of the present invention to provide apparatus for safely and cleanly recovering waste toner particles within an electrostatographic reproduction machine.

It is another object of the present invention to provide a method and apparatus for recovering waste toner particles as a solid mass such that the recovered solid mass is clean and easy to handle, and is not difficult to sort or recycle.

In accordance with the present invention, apparatus is provided for recovering waste toner particles in an electrostatographic reproduction machine. The waste toner recovering apparatus comprises (i) a movable heating member for heating and melting particles of toner; (ii) a device for feeding particles of waste toner to the movable heating member; and (iii) a rotatable transfer-receiving means which forms a transfer nip with the movable heating member for transfer-receiving melted toner from the movable heating member.

The method of the present invention includes the steps of (a) heating a moving first member to a temperature sufficient to melt waste toner particles; (b) feeding waste toner particles onto such a moving first member for melting; (c) forming a transfer nip between the moving first member and a rotatable second member; (d) transfer-receiving melted toner onto the rotatable second member from the moving first member; and (e) cooling the received melted toner to form a solid mass thereof on the rotatable second member.

BRIEF DESCRIPTION OF THE DRAWINGS

In the detailed description of the invention presented below, reference is made to the drawings, in which.

DETAILED DESCRIPTION OF THE PREFERRED EMBODIMENT

Because electrostatographic reproduction apparatus or machines such as copiers and printers are well known, the present description will be directed in particular to elements of such copiers and printers forming part of or cooperating more directly with the present invention. Elements not specifically shown or described herein are thus selectable from those known in the prior art.

Figure 1:
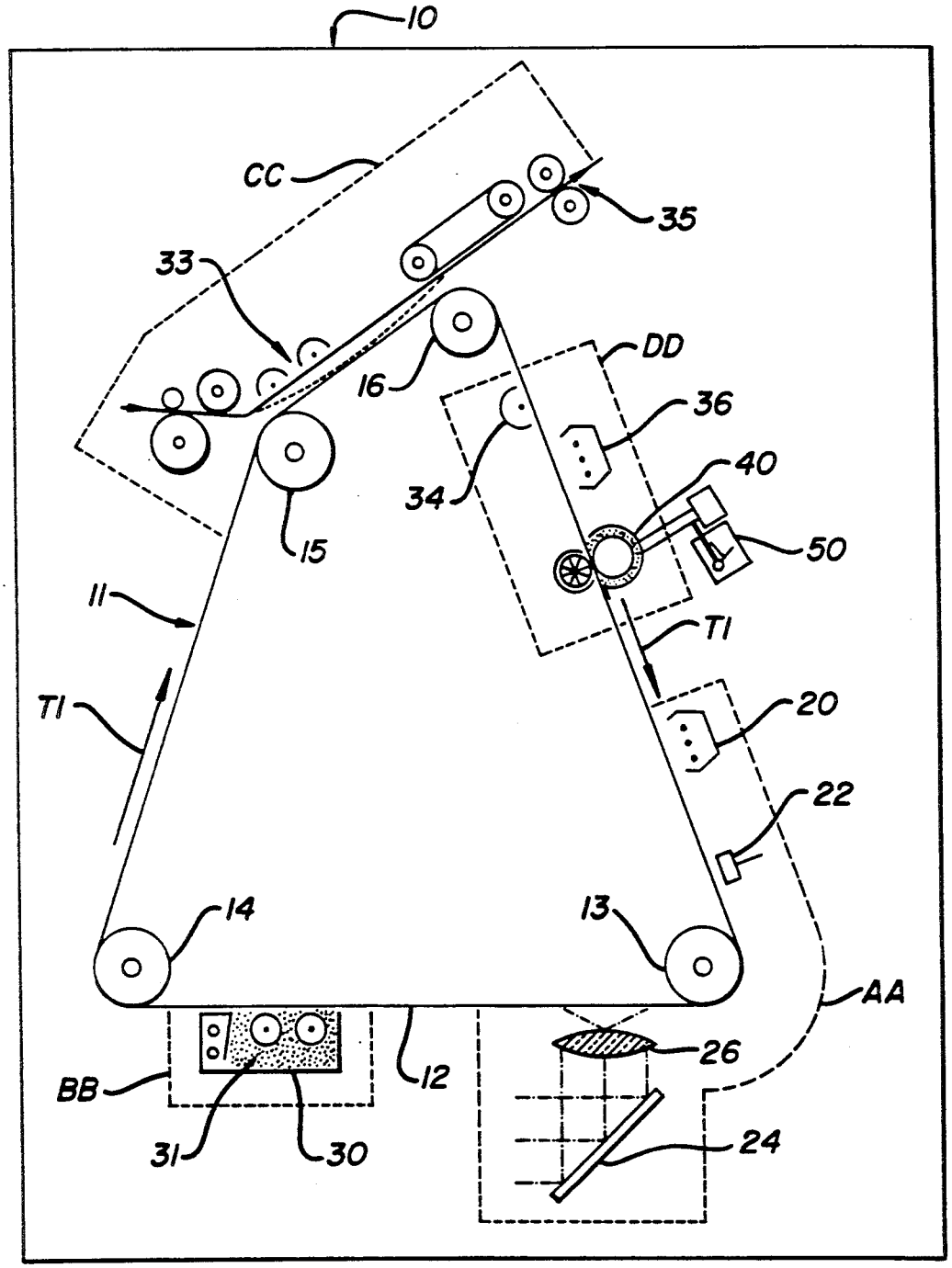
FIG. 1 is a schematic illustration of an electrostatographic reproduction machine such as an optical copier including the waste toner recovering apparatus of the present invention.

Referring now to FIG. 1, an electrostatographic reproduction machine such as an optical electrophotographic copier is shown generally as 10, and includes an image-bearing member 11 which has a frontside image-bearing surface 12. As shown, the member 11 is a flexible photoconductive web trained about a series of rollers 13 through 16 for movement in the direction, for example, of the arrow T1. One of the rollers, such as the roller 13, can be a drive roller for repeatedly moving the member 11 through a series of electrostatographic process stages shown as AA, BB, CC and DD. Although the member 11 is shown as an endless flexible web trained about the series of rollers, it should be understood that a rigid photoconductive drum, having an image-bearing surface, can also be used.

As shown in FIG. 1, clean and charge-free portions of the image-bearing member 11 for example, initially move through the stage shown as AA where electrostatic charges and/or light, are used in one manner or another (as is well known in the art) to electrostatically form latent images of an original document on the surface 12. Typically, the stage AA includes contamination sensitive components such as a primary charger 20 or other charge depositing component (not shown). The electrostatic image of an original can thus be formed on the surface 12, for example, by charging the surface 12 using the primary charger 20, and then imagewise discharging portions of such surface using an electronic printhead 22 and/or an optical system. A typical optical system has a light source (not shown) that illuminates a document sheet such that the light rays from the document sheet are reflected by a mirror 24 through a lens 26 onto the surface 12, thereby imagewise exposing or imaging the surface 12.

The imaged portion of the image-bearing member 11 next moves to the stage shown as BB where the latent image thereon is developed, that is, made visible with charged particles of toner. Stage BB normally includes a development station 30 that contains a developer material 31 which may be comprised of toner particles only, or of a mixture of oppositely charged magnetic carrier particles and toner particles. In order to achieve high resolution development at this Stage BB, it is known to use such developer material 31 which may comprise fine toner particles and a carrier consisting of small, hard magnetic ferrite particles. During development of the image at the station 30, the toner particles of the developer material 31 transfer to the image-bearing surface 12, and there adhere to the electrostatically formed image, thereby making such image visible.

After such development, each particular portion of the image-bearing member 11 carrying the toner developed or visible image thereon, next moves to the stage shown as CC. Stage CC usually includes an image transfer station shown as 33 where the visible toner image on the surface 12 is transferred to a suitable receiver such as a sheet of paper which is fed in registration to the station 33 along a sheet travel path. Typically, such image transfer may be effected electrostatically or by contact and pressure within a transfer nip. After such image transfer, the receiver sheet then travels to a fusing station 35, as shown, where the image is permanently fused to such receiver sheet to form a permanent copy of the original documents. The member 11 meanwhile moves on about the series of rollers 13 through 16 towards the initial stage AA in order to begin another imaging cycle.

On leaving the transfer station 33, each used portion of the surface 12 on which a toner image has been formed and transferred as described above ordinarily will be contaminated with residual charges as well as with residual particles, principally residual or waste toner particles. To ensure the continued production of high quality images and high quality copies during subsequent cycles of the imaging process, it is necessary therefore to effectively clean, that is, to effectively remove such waste toner particles from each such used portion of the surface 12. Accordingly, such cleaning is carried out at the stage shown as DD where apparatus or devices are located for removing residual charges and residual particles. As shown for example, residual charges can be removed by a discharge lamp 34 and/or neutralized by a corona 36, and the waste toner particles can be removed by a cleaning apparatus shown as 40. The cleaning apparatus 40, for example only, can be a fiber brush apparatus, as is well known in the art, with a vacuum plenum which removes waste toner particles from the brush. Waste toner particles removed by the apparatus 40 can then be recovered therefrom safely and cleanly by the waste toner recovering apparatus of the present invention shown generally as 50.

Figure 2:
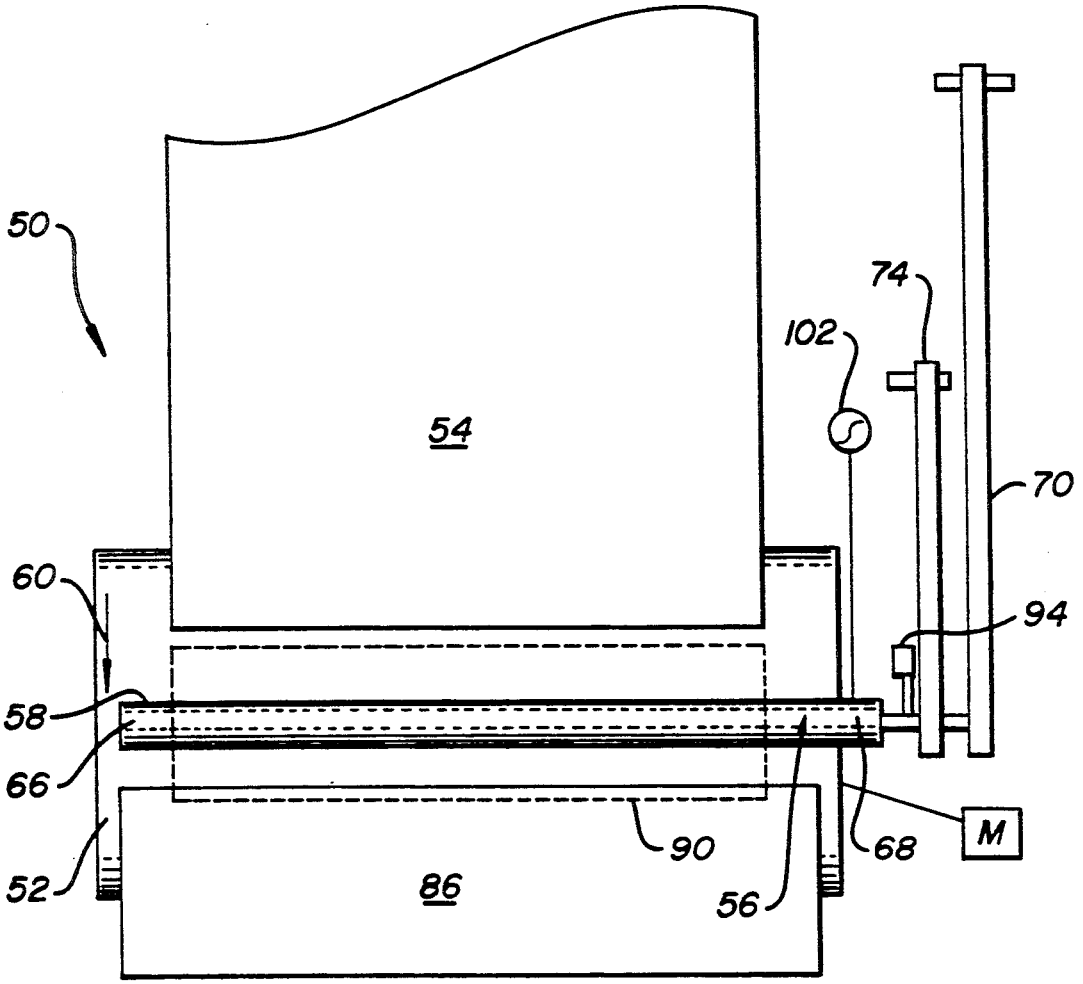
FIG. 2 is a side view of the waste toner recovering apparatus of FIG. 1.

Referring now to FIGS. 2 and 3, the waste toner recovering apparatus 50 is shown and includes a housing 51, a first, movable heating member 52 shown in the form of a rotatable drum for heating and melting particles of waste toner. Such waste toner particles can be fed to the first, movable heating member 52 by means, for example, of a narrow chute 54 that extends from one end to the other of the first heating member 52, and that is connected by conventional means to the cleaning apparatus 40 such that waste toner particles from the cleaning apparatus are allowed, for example, to fall through the feed chute 54. The feed chute 54 is positioned so that toner particles are delivered to the drum 52 at a point downstream of a vertical line 55 relative to the rotation of the drum.

The waste toner recovering apparatus 50 also includes a second, rotatable transfer-receiving means 56 shown in the shape of a roller which forms a toner transfer nip 58 with the surface 62 of the first heating member or drum 52. The first heating member or drum 52 is supported by means 70, and can be driven by drive means M for movement in the direction of the arrow 60. As such, the transfer-receiving second member 56 can be frictionally driven by the driven first heating member 52 in the direction, for example, of the arrow 72. Melted toner on the first heating member 52 can thus be transferred through the nip 58 onto the surface of the rotatable receiving member 56.

Figure 3A:
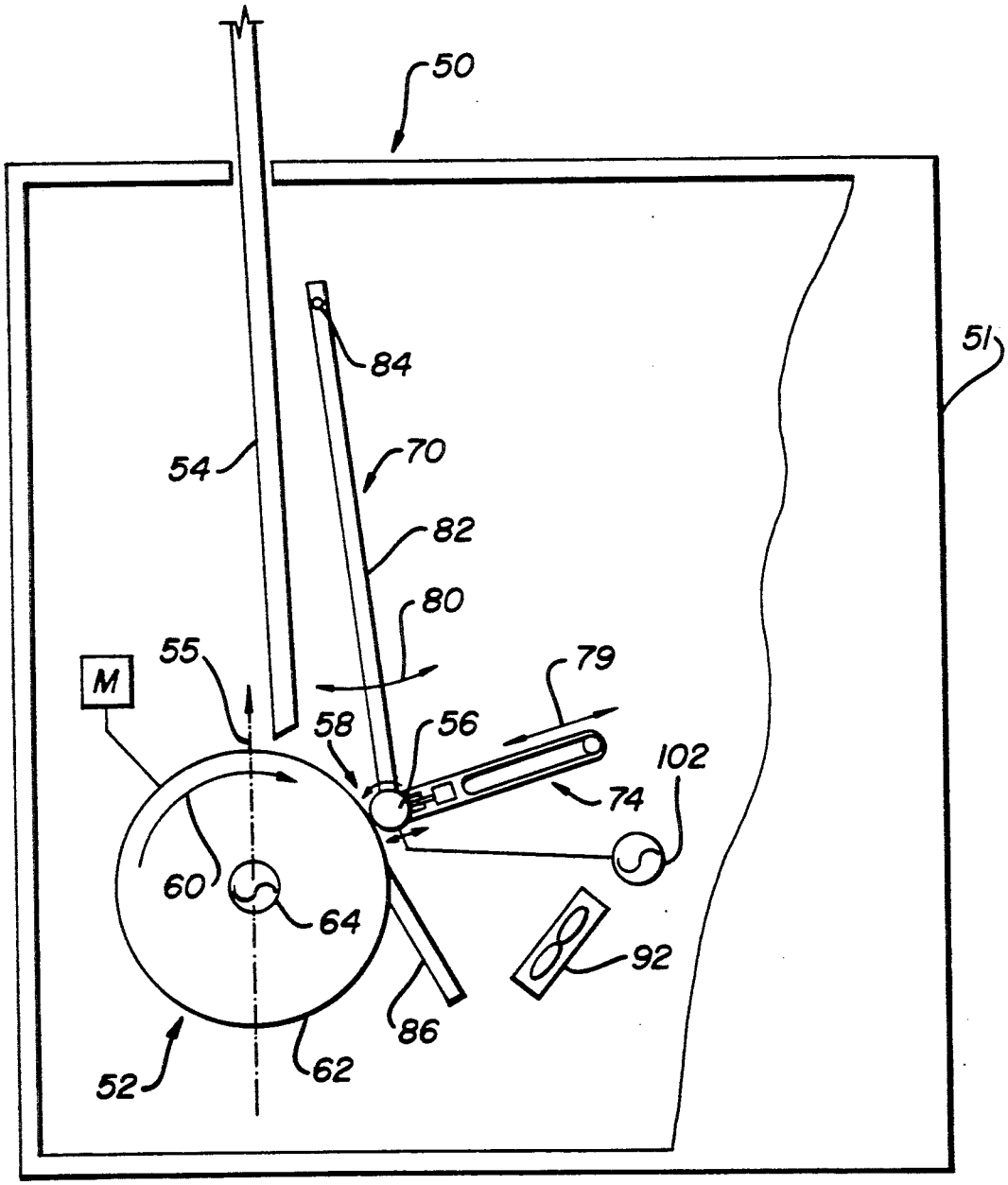
FIG. 3A is an end view, cut out for details, of the apparatus of FIG. 2 prior to any toner recovery.
Figure 3B:
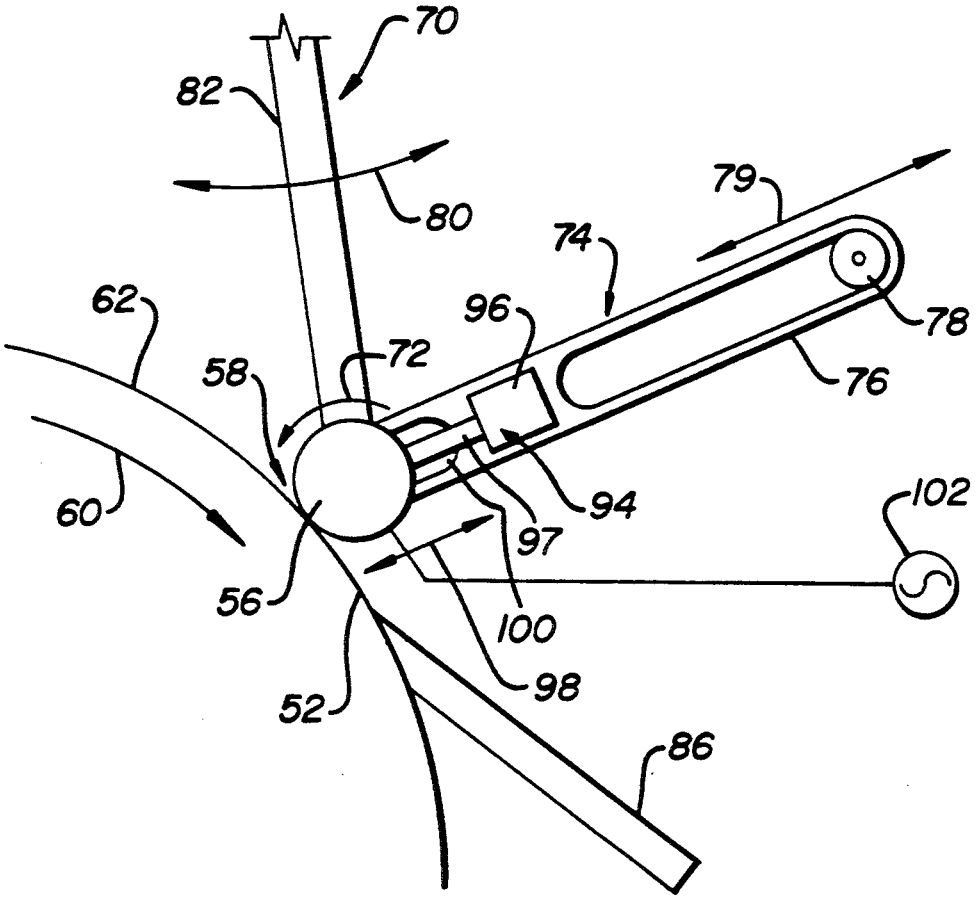
FIG. 3B is an enlarged portion of FIG. 3A about the transfer nip of the present invention.
Figure 4:
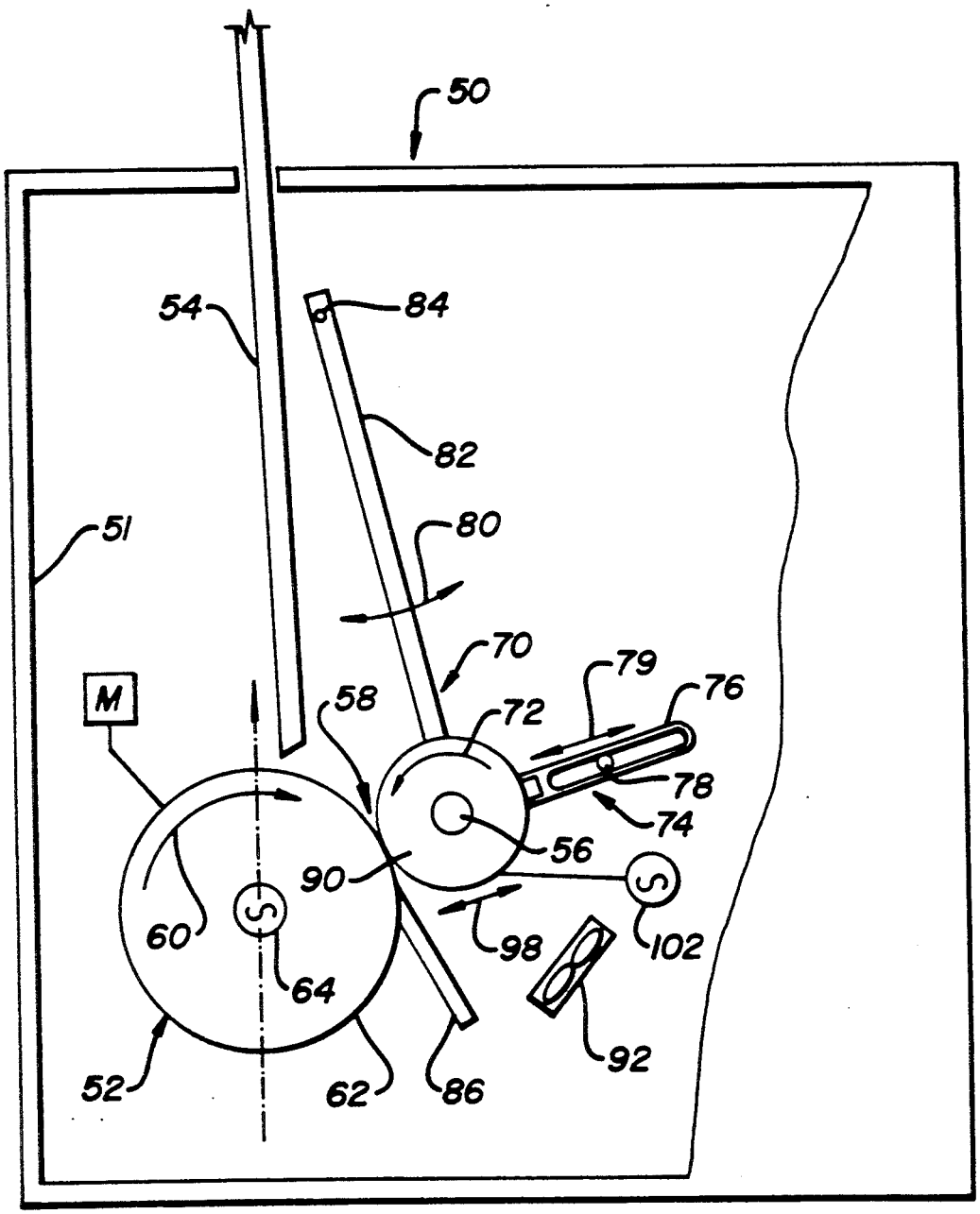
FIG. 4 is the same as FIG. 3A showing a mass of recovered waste toner.

Referring now to FIGS. 2 to 4, the movable first heating member or drum 52 has a smooth surface 62 that is suitable for melting toner thereon so that the melted toner is easy to take off or remove. As shown, the drum 52 includes a heat source 64 such as an internal lamp for heating the drum 52 so that its exterior surface 62 reaches a temperature that is sufficient to melt toner particles or toner powder brought into contact therewith. When heated internally, the drum 52 should therefore be made of a heat conductive material such as aluminum. As can be understood, the drum 52 may otherwise also be heated externally.

As shown particularly in FIG. 3B, the waste toner recovering apparatus 50 includes means 74 consisting, for example, of a movable slotted bracket 76 and a fixed pin 78 for allowing movement of the rotatable receiving member 56 into and out of contact with the exterior surface 62 of first heating member 52. The bracket 76 can thus move relative to the pin 78 in a manner as shown by the arrow 79. Accordingly, the receiving member 56 is supported by the means 70, so that such means 70 can also move as shown by the arrow 80 (FIGS. 3A, 4 and 5) towards and away from the first heating member 52. As illustrated for example, the means 70 may include a long support bracket 82 pivotably mounted at a point 84 for such movement.

Prior to any waste toner recovery by the apparatus 50, the melted toner receiving member or roller 56 is in direct frictional nip contact within the nip 58 with the exterior surface 62 of first heating member or drum 52 as shown in FIGS. 3A, 3B. First heating member 52 should be heated, for example, by the heat source 64 until the surface 62 therefore is hot enough, for example 140° F. (60° C.) or thereabout, so as to melt particles of the waste toner from the cleaning apparatus 40. While driving or moving the member 52, waste toner particles can then be fed onto such moving or rotating first heating member 52, at a position downstream of vertical relative to its direction of rotation. The waste toner particles should be fed at a controlled rate such that they are substantially all melted by the time they are moved into and through the transfer nip 58.

Within the transfer nip 58, the melted toner will be transfer-received from the surface 62 of the moving first heating member 52 initially onto the surface of the rotatable receiving member 56 in order to form a mass or plug 90 of melted toner thereon. Such transfer can be facilitated, for example, by making the surface of the receiving roller 56 rough and that 62 of the drum 52 smooth, and additionally by making sure that the surface 62 is higher in temperature than that of the receiving roller 56. Subsequently, melted toner within the nip 58 will transfer from the surface 62 of the heating member 52 onto the surface of the mass 90 of melted toner that had already been received on the receiving member 56. To clean the surface 62 and enhance melted toner transfer within the nip 58, means 86 such as a skive may be mounted immediately to the exit side of the nip 58 to scrape any residual melted toner off the surface 62 back into transfer contact with the receiving member 56 or with the toner mass 90 thereon. For such transfer enhancement, means including an air fan 92 may also be included for cooling and thereby causing each layer of the mass 90 of melted toner to solidify during each revolution of the rotating receiving member 56.

Figure 5:
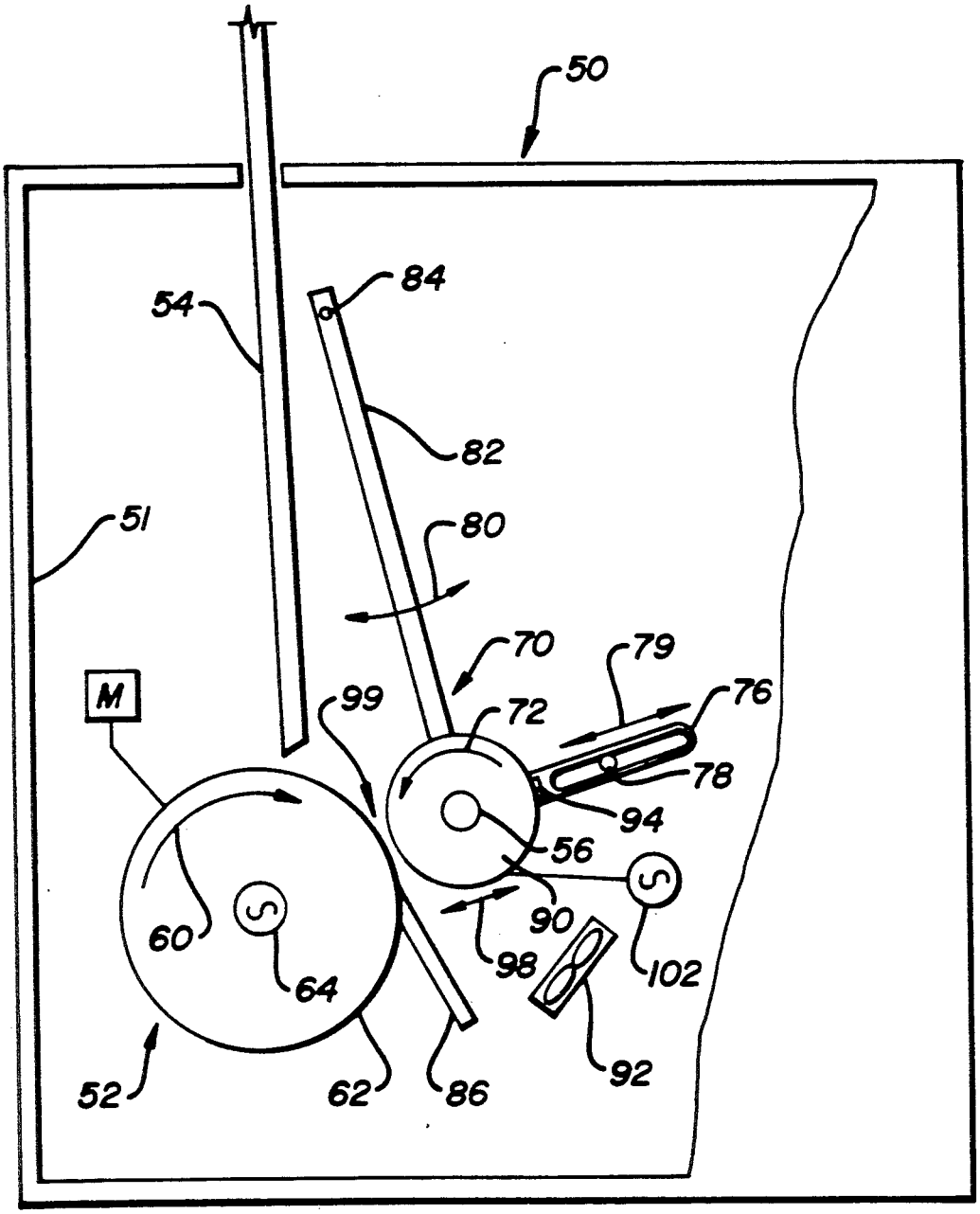
FIG. 5 is the same as FIG. 4 with the mass of recovered waste toner spaced from the first moving member of the apparatus of FIG. 2.
Figure 6:
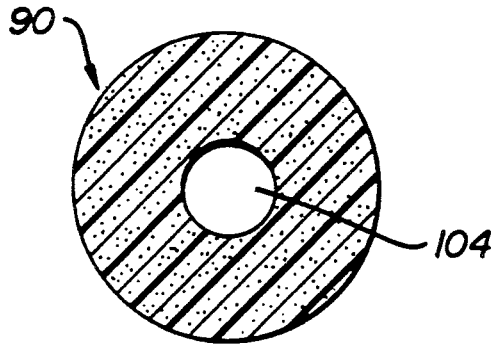
FIG. 6 is an end section of a cylindrical mass of recovered waste toner from the apparatus of the present invention.

Referring now to FIGS. 2 and 3B-5, the waste toner recovering apparatus 50 further includes means shown generally as 94 for separating the rotatable receiving member 56, as well as a mass or plug 90 of melted toner thereon, from the exterior surface 62 of first heating member 52. The means 94 for, example, may include a solenoid 96 having a plunger portion 97 for moving the receiving member 56 (FIG. 3B) into and out of contact with the surface 62 as indicated by the arrow 98. As shown in FIG. 5, when the plunger 97 is in a retracted position it creates a spacing 99 between the surface 62 and mass 90 of melted toner on receiving member 56.

Note that the separation of the receiving member 56 by the means 94 from the surface 62 is different from the ability of the receiving member 56 to move with the bracket 76 towards and away from the surface 62. With the latter movement, mere build-up of the mass 90 of melted toner on the receiving member 56 will cause the bracket 76 to move with respect to the pin 78 thereby spacing the receiving member 56 from the surface 62, even though the mass 90 of melted toner remains in contact with the surface 62. On the other hand, in order to space the mass 90 from the surface 62, the means 94 is mounted (FIG. 2) so as to move the receiving member or roller 56 by means of its shaft through a second slot 100 in the bracket 76, with respect to such bracket 76. Such spacing of the mass 90 from the heated surface 62, aids in the cooling of the mass 90, as well as ensures that the mass 90 does not solidify while in contact with surface 62 especially when both have cooled off.

Referring now to FIGS. 2 to 6, the waste toner recovery apparatus includes second heating means 102 such as an AC current source for selectively heating the receiving member 56 to a high temperature, for example, 250° F. sufficient to remelt solidified toner that is in direct contact therewith. Portions of the receiving roller 56 which are not in direct contact with the mass 90 of solid toner should, of course, be designed so as to be insulated from the heating and electrical effects of the source 102.

Since the receiving roller 56 is supported in a cantilevered manner only at its second end 68, a reasonable axial force applied as by an operator to the cylindrical mass 90 of melted toner from such second end 68 towards the first end 66 should cause the mass 90, (given sufficient remelting of its core which is in direct contact with heated roller 56), to move in such second end to the first direction of such force. As such, the cylindrical mass 90 of solid toner, now having a hollow core 104 (FIG. 6), can be removed or slipped out over the first end 66 of the receiving member 56 for subsequent handling. After such removal, the heat source 102 can be turned off, and the receiving member 56 reset into direct frictional and driving engagement against the surface 62 of member 52 ready to start recovering another such solid mass 90 of melted toner.

Subsequent handling of the solid means 90 of melted toner from the apparatus of the present invention is very clean and safe particularly because such melted toner once cooled is as inert as any other solid block of plastic material. Additionally, classification of the solid cylinder of toner is simple and straight forward since there are no inseparable containers solidified therewith.

The invention has been described in detail with particular reference to a presently preferred embodiment, but it will be understood that variations and modifications can be effected within the spirit and scope of the invention.

What is claimed is:

1. Apparatus for recovering waste toner in an electrostatographic reproduction machine, the waste toner recovering apparatus comprising:

(a) means including a movable heating member for heating and melting particles of toner;

(b) feed means for feeding particles of toner to said movable heating member; and (c) rotatable receiving means forming a transfer nip with said movable heating member for transfer-receiving melted toner from said movable heating member.

2. The waste toner recovering apparatus of claim 1 wherein said movable heating member is a rotatable drum.

3. The waste toner recovering apparatus of claim 1 wherein said toner particle feed means is a narrow chute connected to a cleaning apparatus of the reproduction machine.

4. The waste toner recovering apparatus of claim 1 wherein said melted toner receiving means is movable into and out of contact with said movable heating member.

5. The waste toner recovering apparatus of claim 1 including means for cooling and solidifying the melted toner received into a mass on said melted toner receiving means.

6. The waste toner recovering apparatus of claim 2 wherein said rotatable drum is heated internally.

7. The waste toner recovering apparatus of claim 3 wherein said toner particle feeding chute is positioned to deliver toner particles to said movable heating member at a point downstream of a vertical line through the center of said movable heating member relative to the direction of movement of said movable heating member.

8. The waste toner recovering apparatus of claim 4 wherein said rotatable receiving means is movable away from said movable heating means by melted toner building up externally on said rotatable receiving means.

9. The waste toner recovering apparatus of claim 5 wherein said means for cooling and solidifying melted toner includes a fan for blowing air onto the melted toner on said melted toner receiving means.

10. Apparatus for recovering waste toner in an electrostatographic reproduction machine, the waste toner recovering apparatus comprising:

(a) means including a first rotatable member having an exterior surface suitable for melting toner particles thereon;

(b) first heating means for heating said first rotatable member such that said exterior surface thereof has a temperature sufficient to melt toner particles;

(c) feed means for feeding toner particles onto said exterior surface of said first rotatable member;

(d) a second rotatable member having first and second ends, said second rotatable member forming a transfer nip with said first rotatable member for transfer-receiving melted toner from said exterior surface of said first rotatable member; and (e) drive means for rotatably driving said first and said second rotatable members through said transfer nip.

11. The apparatus of claim 10 including second heating means for selectively heating said second rotatable member.

12. The apparatus of claim 10 including means for separating melted toner received on said second rotatable member from contact with said exterior surface of said first rotatable member.

13. The apparatus of claim 10 and including means for cooling melted toner received on said second rotatable member.

14. The apparatus of claim 11 wherein said second rotatable member is supported rotatably only at a second end thereof in a cantilevered manner.

15. An electrostatographic reproduction machine having an image-bearing surface and means for forming images thereon using powdery toner particles, the reproduction machine including waste toner recovering apparatus comprising:

(a) a first rotatable roller including first heating means for heating and melting toner particles;

(b) feed means for feeding waste powdery toner particles onto said first rotatable roller; and (c) a second rotatable roller forming a transfer nip with said first rotatable roller for transfer-receiving melted toner from said first rotatable roller.

16. In an electrostatographic reproduction machine having an image-bearing surface and means for forming and transferring images therein using toner particles, a method for recovering waste toner particles, the method comprising the steps of:

(a) heating a moving first member to a temperature sufficient to melt waste toner particles;

(b) feeding waste toner particles onto the moving first member;

(c) transfer-receiving the melted toner from the moving first member onto a movable second member; and (d) cooling the received melted toner so as to form a solid mass thereof on the movable second member.

17. The method of claim 16 wherein said melted toner transfer-receiving step includes forming a direct transfer nip between the moving first member and the movable second member.

18. The method of claim 16 further including the steps of:

(a) heating said movable second member so as to remelt portions of the solidified mass of melted toner in direct contact with said movable second member; and (b) applying a force to said solidified mass of melted toner for removing such mass from said movable second member.

19. The method of claim 16 wherein said cooling and solidifying step includes first separating portions of the surface of the moving first member in contact with the solidified mass of melted toner on the movable second member.

20. The method of claim 17 wherein said moving first member and said movable second member are moved rotatably through said transfer nip.

* * * * *